US009353723B2

(12) United States Patent
Bengtsson et al.

(10) Patent No.: US 9,353,723 B2
(45) Date of Patent: May 31, 2016

(54) IGNITION SYSTEM INCLUDING A MEASUREMENT DEVICE FOR PROVIDING MEASUREMENT SIGNALS TO A COMBUSTION ENGINE'S CONTROL SYSTEM

(71) Applicant: SEM AB, Amal (SE)

(72) Inventors: Jorgen Bengtsson, Svanskog (SE); Bert Gustafsson, Amal (SE)

(73) Assignee: SEM AB, Amal (SE)

( * ) Notice: Subject to any disclaimer, the term of this patent is extended or adjusted under 35 U.S.C. 154(b) by 92 days.

(21) Appl. No.: 14/396,919

(22) PCT Filed: Apr. 11, 2013

(86) PCT No.: PCT/SE2013/050390

§ 371 (c)(1),
(2) Date: Jan. 18, 2015

(87) PCT Pub. No.: WO2013/154491

PCT Pub. Date: Oct. 17, 2013

(65) Prior Publication Data

US 2015/0330353 A1 Nov. 19, 2015

(30) Foreign Application Priority Data

Apr. 13, 2012 (SE) ..... 1250371

(51) Int. Cl.
*F02P 9/00* (2006.01)
*F02P 15/08* (2006.01)
(Continued)

(52) U.S. Cl.
CPC ..... *F02P 9/002* (2013.01); *F02D 35/021* (2013.01); *F02P 3/0807* (2013.01); *F02P 17/12* (2013.01);
(Continued)

(58) Field of Classification Search
CPC ..... F02P 3/04; F02P 3/05; F02P 3/0407; F02P 3/0876; F02P 3/0807; F02P 9/002; F02P 15/08; F02P 15/12; F02P 17/12; F02B 1/00; F02B 1/02; F02B 5/00; F02B 23/08; F02D 35/021; F02D 37/02; F02D 43/00; F02D 2200/1015; G01L 23/22
USPC ..... 123/406.14, 406.27, 596, 604, 620, 123/621, 623, 625, 636, 637, 644, 696; 73/114.02, 114.08; 324/380, 391
See application file for complete search history.

(56) References Cited

U.S. PATENT DOCUMENTS 5,970,965 A 10/1999 Bentel et al.
6,189,522 B1 * 2/2001 Moriya ..... F02P 15/08 123/643

(Continued)

OTHER PUBLICATIONS

International Search Report and Written Opinion dated Aug. 26, 2013 for PCT/SE2013/050390, 8 pages.

*Primary Examiner* — Grant Moubry
(74) *Attorney, Agent, or Firm* — John M. Harrington, Esq.; Johnson, Marcou & Isaacs, LLC

(57) ABSTRACT

The present invention relates to an ignition system (T) for a combustion engine, the internal combustion engine comprising a control system, the ignition system (T) further comprising a power source (30), at least one ignition coil (10, 11, 12) having at least one primary coil (L2, L4, L6) and one secondary coil (L3, L5, L7) for a spark plug (13, 14, 15) and a measurement device (50) for at least one of the parameters spark current, ion current, ignition voltage and primary voltage, said measurement device (50) being adapted to provide measurement signals to said control system for regulating the ignition system (T), the ignition system (T) also comprising means for transforming up voltage and storing energy, and a plurality of switches (S1-S7), said control system being adapted to control said switches (S1-S7), by means of said measuring signal(s), for the supply of adaptive spark energy and/or to control the polarity of the spark.

14 Claims, 7 Drawing Sheets

(51) Int. Cl.
*F02P 17/12* (2006.01)
*F02P 3/08* (2006.01)
*F02D 35/02* (2006.01)

(52) U.S. Cl.
CPC ..... *F02D 2200/1015* (2013.01); *F02P 3/0876* (2013.01); *F02P 2017/121* (2013.01); *F02P 2017/125* (2013.01)

(56) References Cited

U.S. PATENT DOCUMENTS 6,298,837 B1 10/2001 Ketterer et al.
6,837,229 B2 * 1/2005 Mizutani ..... F02P 3/051 123/596
6,922,057 B2 * 7/2005 Zhu ..... F01N 3/2006 324/382
7,347,195 B2 * 3/2008 Biljenga ..... F02P 9/007 123/620
7,392,798 B2 * 7/2008 Wada ..... F02P 3/051 123/620
7,401,603 B1 * 7/2008 Lepley ..... F02P 3/0846 123/598
7,404,396 B2 * 7/2008 Toriyama ..... F02P 3/0552 123/598
8,276,564 B2 * 10/2012 Petruska ..... F02P 15/02 123/406.12
2002/0144539 A1 10/2002 Yorita et al.

* cited by examiner

IGNITION SYSTEM INCLUDING A MEASUREMENT DEVICE FOR PROVIDING MEASUREMENT SIGNALS TO A COMBUSTION ENGINE'S CONTROL SYSTEM

CROSS REFERENCE TO RELATED APPLICATIONS

This application is a 35 U.S.C. §371 national stage of International Application No. PCT/SE2013/050390 filed on Apr. 11, 2013, published in English under PCT Article 21(2), which claims the benefit of priority to Swedish Patent Application No. 1250371-0 filed on Apr. 13, 2012, the disclosures of which are hereby incorporated by reference.

FIELD OF THE INVENTION

The present invention relates to an ignition system for an internal combustion engine, the engine comprising a control system; further the ignition system comprises a power source, at least one ignition coil having at least one primary coil and secondary coil for a spark plug, and a measurement device for at least one of the parameters spark current, ion current, ignition voltage and primary voltage, said measurement device being adapted to provide measurement signals to said control system for controlling the ignition system.

BACKGROUND ART

In engines for alternative fuels, the increasing need for ignition voltage and increased spark-plug wear are a growing problem. Engines powered by alternative fuels need a varying amount of ignition voltage and energy of the spark, depending on the fuel used. There are also engines with variable EGR (Exhaust Gas Recirculation) and in case of high EGR, the ignition of the fuel mixture is more difficult and requires a high-energy spark. To achieve ignition, the ignition parameters such as ignition voltage, spark burn time and peak current of the spark are often maximised, causing substantial wear of the spark plugs. Furthermore, the burn time of the spark is affected by turbulence and pressure in the combustion chamber, and if the current of the spark is too low it can go out by itself, making the release of a new spark necessary, which also results in considerable wear. Another parameter that affects spark-plug wear is the polarity of the spark.

U.S. Pat. No. 7,347,195 discloses a method to control the current to a spark plug to enable control of the intensity and/or duration of an ignition spark. The system enables a spark during a predetermined burn time, to individually adapt the ignition current to the current operating mode of the engine or to external conditions such as fuel quality and/or weather. The system comprises a first and a second circuit, the first circuit being a conventional inductive ignition system, and the second circuit including a control circuit connected to a second side of the ignition coil to control the duration and current of a spark.

U.S. Pat. No. 6,189,522 discloses an ignition system comprising an ignition coil to simultaneously ignite a pair of spark plugs. The system further comprises a switch which, when assuming an operating mode, causes the first spark plug to generate a negative spark and the second spark plug to generate a positive spark. When another operating mode is assumed the opposite happens: the spark plugs switch polarities.

BRIEF DESCRIPTION OF THE INVENTION

It is an object of the present invention to eliminate or at least minimise the above-mentioned problems, which is achieved by an ignition system as claimed in claim 1.

The invention provides for a controllable ignition system with feedback which can measure all or any of the following parameters: ignition voltage, misfiring, spark burn time and peak-pressure position. The ignition system can provide information to engine control or itself determine the energy combination that works without misfiring and/or provides optimum combustion with minimum spark-plug wear.

According to one aspect of the invention, the number of storage capacitors used for spark generation can be varied, providing the advantage that the peak current can be varied without affecting the ignition voltage; lower peak current results in less spark-plug wear.

According to another aspect of the invention, the measurement device includes two resistors having a difference in magnitude of at least $10^2$, resulting in the advantage that the spark current can be measured.

According to a further aspect of the invention, the ignition system includes an ignition-voltage measurement device offering the advantage that the ignition voltage can be measured.

According to yet another aspect of the invention, two transistors are used in the ignition-voltage measurement device, enabling both positive and negative polarity of the spark to be measured, and that the ignition-voltage measurement device has two voltage limits protecting the transistors from receiving the wrong signal.

According to yet another aspect, the control system utilises the switches to control the spark's polarity so that the polarity requiring the least ignition voltage is used.

According to a further aspect of the invention, ion-current measurements are used to detect misfiring, and, together with information on required ignition voltage, energy for reliable ignition can be adapted.

According to yet another aspect of the invention, the spark current may be measured to detect whether the spark goes out prematurely, and in this case a storage capacitor can be fired immediately to prevent misfiring.

According to a further aspect of the invention, the choice of switches provides the advantage of making the use of energy boost easier and cheaper.

BRIEF DESCRIPTION OF THE DRAWINGS

The invention will be described in more detail below with reference to the accompanying drawings, wherein.

DETAILED DESCRIPTION OF THE DRAWINGS

Figure 1:
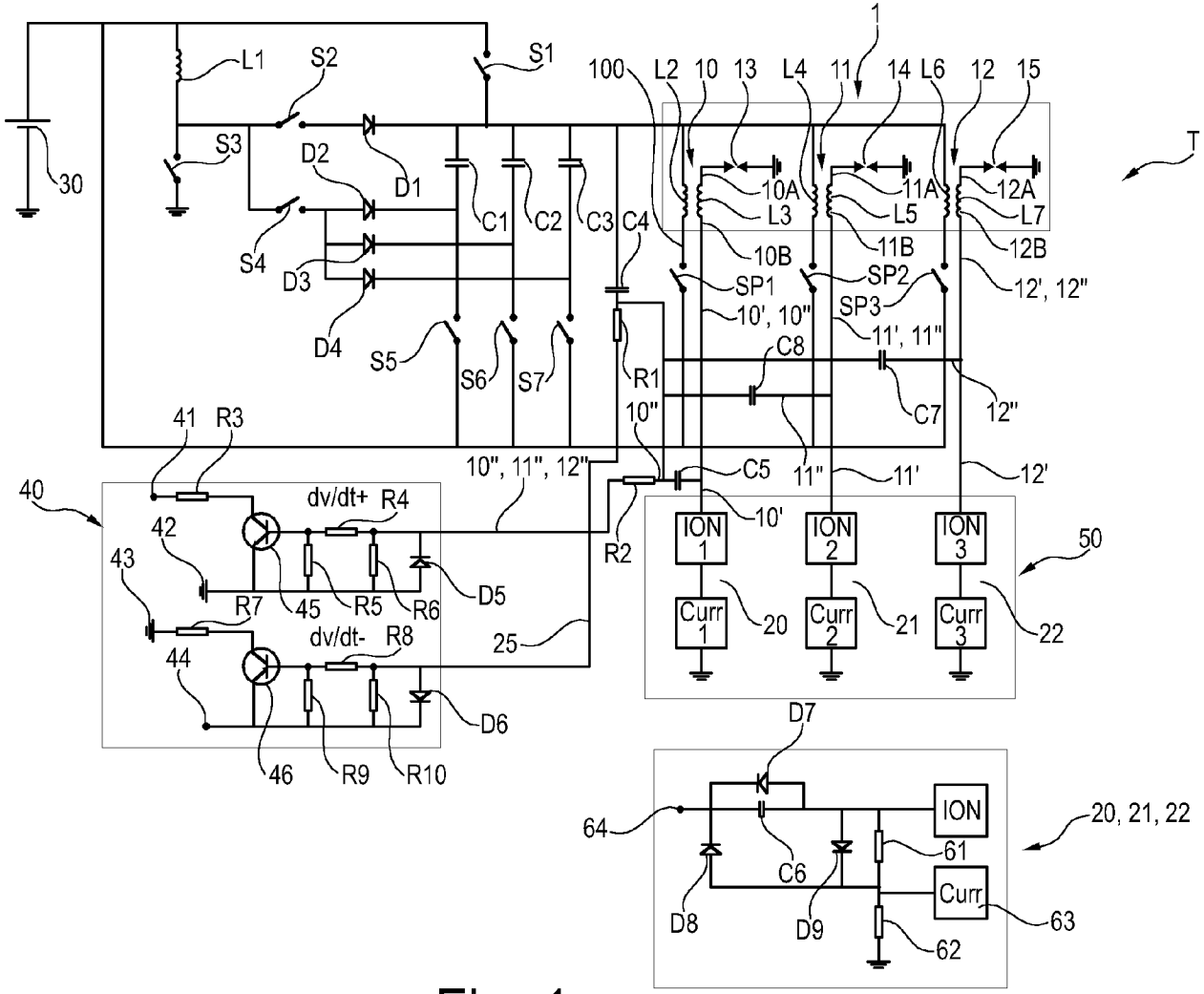
FIG. 1 shows a circuit diagram of an ignition system according to a preferred embodiment of the invention.

A vehicle comprises a control system (not shown) which, inter alia, controls the combustion of the engine by, inter alia, providing an ignition system T with control signals, which is shown in FIG. 1 according to a preferred embodiment of the invention. The control/regulation may be in the form of either an overall control system or multiple control systems, such as a master engine-control system with a slave ignition-control system. Therefore, in certain embodiments, the ignition system T can be arranged with a separate ignition-control system, subordinate to the engine-control system, meaning that the ignition system can include its own adaptive functionality, such as to adapt the time of the spark. The ignition system T comprises spark-generating means 1 comprising at least one, in this preferred example, a first 10, a second 11, and a third 12 ignition coil. Each ignition coil 10, 11, 12 in turn comprises a primary winding L2, L4, L6 and a secondary winding L3, L5, L7. The three primary windings L2, L4, L6 are supplied with power from a power source 30, such as a battery or capacitor, to induce a current into the secondary winding L3, L5 L7. Connected to the three primary windings L2, L4, L6 are a first Sp1, a second Sp2 and a third Sp3 coil switch controlling the current to the primary windings L2, L4, L6.

The three secondary windings L3, L5, L7 comprise a first end 10A, 11A, 12A, each one connected to a spark plug 13, 14, 15, and a second end 10B, 11B, 12B, each one connected, via a conductor 10', 11', 12', to a measurement device 50 which measures the ion current by means of an ion-current circuit 20, 21, 22, described in more detail below. By measuring the ion current, information can be obtained on combustion and the position of the peak pressure. Failed combustion when the engine is provided with fuel, air and spark is regarded as misfiring. The three secondary windings L3, L5, L7 are also connected, via a return conductor 10", 11", 12", to an ignition-voltage measurement device 40 where the transient from the sparkover is measured, which provides information such as ignition voltage and whether the spark goes out prematurely.

The ignition system T further comprises at least on choke coil L1, at least one, in this case three, storage capacitors C1, C2, C3, and a number of switches, in this case a first S1, a second S2, a third S3, a fourth S4, a fifth S5, a sixth S6 and a seventh S7 switch, and a number of diodes, in the described example four diodes: D1, D2, D3, D4.

The ion-current circuits 20, 21, 22 each comprise a capacitor C6, first D8 and second D9 diodes, a zener diode D7, and two resistors 61, 62. The resistance of the first resistor 61 is in the order of 1,000 times greater than that of the second resistor 62, whose resistance is in the order of 100 Ω. When a coil switch Sp1-Sp3 closes, after the capacitor has been charged, an ignition spark is produced, which generates a spark current during a certain time at a certain voltage. The spark current passes the ion-current portion via D8 and D9, and can be measured by means of the second resistor 62 in the ion-current circuit 20, 21, 22. The ion current and the spark current enter the ion-current circuit 20, 21, 22 via a first input 64 and the normal ion-current measurement is not disturbed by the second resistor 62 as the resistance for measuring ion current is approximately 1,000 times greater. The ion current is in the order of μA and the spark current in the order of mA.

When one of the coil switches Sp1, Sp2, Sp3 closes, a spark is generated, and depending on the polarity of the spark the transient from the sparkover is captured by different measurement circuits, as described in more detail below.

In an ignition-voltage measurement device 40, it is detected when the transient from the sparkover in the spark plug 13, 14, 15, arrives. The ignition-voltage measurement device 40 comprises a first 41, 42 and a second 43, 44 measurement circuit, the first measurement circuit 41, 42 comprising a first voltage limiter D5; third, fourth, fifth and sixth resistors R3, R4, R5, R6, and a first transistor 45. The second measurement circuit 43, 44 comprises a second voltage limiter D6; seventh, eighth, ninth and tenth resistors R7, R8, R9, R10, and a second transistor 46.

The transient from the sparkover appears in all conductors but in the case of positive polarity of the spark, the transient is captured in the first measurement circuit 41, 42, via the return conductor 10", 11", 12", where a capacitor C5, C7, C8 captures the transient, as the second voltage limiter D6 of the second measurement circuit 43, 44, which works as a protection for the second transistor 46, does not let positive voltage enter the second transistor 46 when the voltage over the input is too great. The return conductor 10", 11", 12" also comprises a low-ohm resistor R2, which determines the sensitivity. It is also possible to capture the transient on the conductor 100 between the primary winding L2 of the first ignition coil and the first coil switch Sp1 if a capacitor is connected in the same way as the fourth capacitor C4 (not shown). In the first measurement circuit 41, 42, the transient travels via the first voltage limiter D5 on through sixth R6 and fourth R4 resistors, and into the base of the first transistor 45. dV/dt+ in the first measurement circuit 41, 42 creates a pulse that goes from Vcc 41 to 0 42 when the transient from the sparkover in the spark plug 13, 14, 15 arrives. In the case of negative polarity, this sub-circuit 41, 42 works on the first oscillation of the ignition voltage, resulting in a positive transient. The fact that a transient is obtained from the sparkover is due to parasitic capacitances in the ignition coil 10, 11, 12 and the sparkover going from several thousand volts to a few hundred volts in a few nanoseconds. The capacitance is normally 10 pF between primary L2, L4, L6 secondary L3, L5, L7 in the ignition coil, and a sparkover of 5 kV during 10 ns produces an interference current induced in return and primary connections of about 5 A (I=C*dV/dt). This current is attenuated and widened due to impedance of the conductor. If that is not enough, the network at the transistor input can be supplemented by one or more capacitors in parallel with the sixth R6 and tenth R10 resistors and/or in parallel with the fifth R5 and ninth R9 resistors (not shown). The time elapsed from the closing of the coil switch Sp1-Sp3 until the transient from the sparkover is captured is proportional to the ignition voltage.

In the case of negative polarity of the spark, the transient is captured in the second measurement circuit 43, 44, via a return conductor 25 where the transient is captured by the same capacitors as in the case of positive polarity, as the first voltage limiter D5 in the first measurement circuit 41, 42 prevents the transient from reaching the first transistor 45. The return conductor 25 also comprises a low-ohm resistor R1, which determines the sensitivity. The transient passes through the second voltage limiter D6 and then through the tenth R10 and eighth R8 resistors, on to the base of the second transistor 46. dV/dt— produces a pulse going from 0 43 to Vcc 44 when the transient from the sparkover arrives.

The measurement devices 40, 50 described above provide signals/input to the control system comprising a processor and software (not shown) which calculates, detects and provides control signals.

The first 41, 42 and second 43, 44 measurement circuits are connected to the control system measuring the time elapsed from the closing of a coil switch Sp1, Sp2, Sp3 until one of the transistors 45, 46 reacts to the transient. The spark from the ignition coil 10, 11, 12 has a known voltage derivative, and by determining the time elapsed between the closing of the coil switch Sp1, Sp2, Sp3 and the transient reaching the transistor 45, 46, one can calculate the ignition voltage.

FIGS. 2-9 show various sequences of the circuit diagram shown in FIG. 1. When all the switches S1-S7 and coil switches Sp1-Sp3 are open, no current flows in the circuit, and by choosing the switches to open/close, one can choose the storage capacitors C1, C2, C3 to be activated when the current is applied. The ignition system T (or engine-control system) comprises a sequence control which controls the switches S1-S7, the coil switches Sp1-Sp3 and the measurement circuits in the correct sequence, which is not described in further detail herein.

Figure 2:
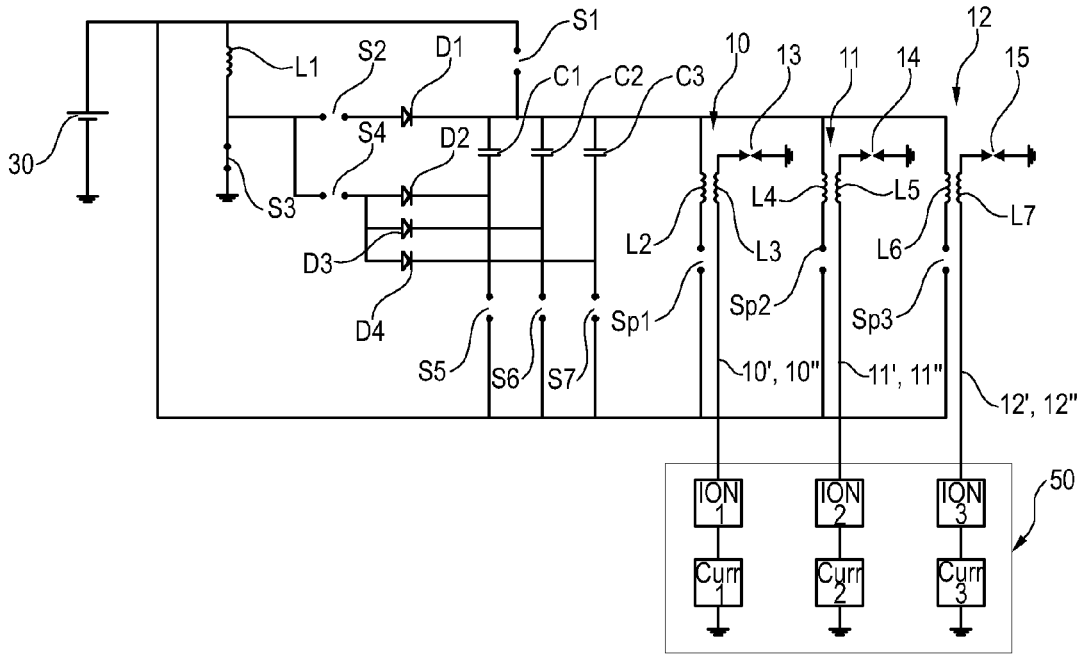
FIGS. 2-8 show sequence diagrams of the system according to the invention.

When the third switch S3 closes, see FIG. 2, the current starts to flow, and depending on how the switches S1-S7 and the coil switches Sp1-Sp3 open and close, different results can be obtained. In FIG. 2, charging of energy takes place in the choke coil L1 from the power source 30, when the third switch S3 closes. When the desired energy level has been reached in the choke coil L1, the third switch S3 opens, while the first switch S1 and the fourth switch S4 close (see FIG. 3), the current flowing through the second D2, third D3 and fourth D4 diodes to the storage capacitors C1, C2, C3.

Figure 4:
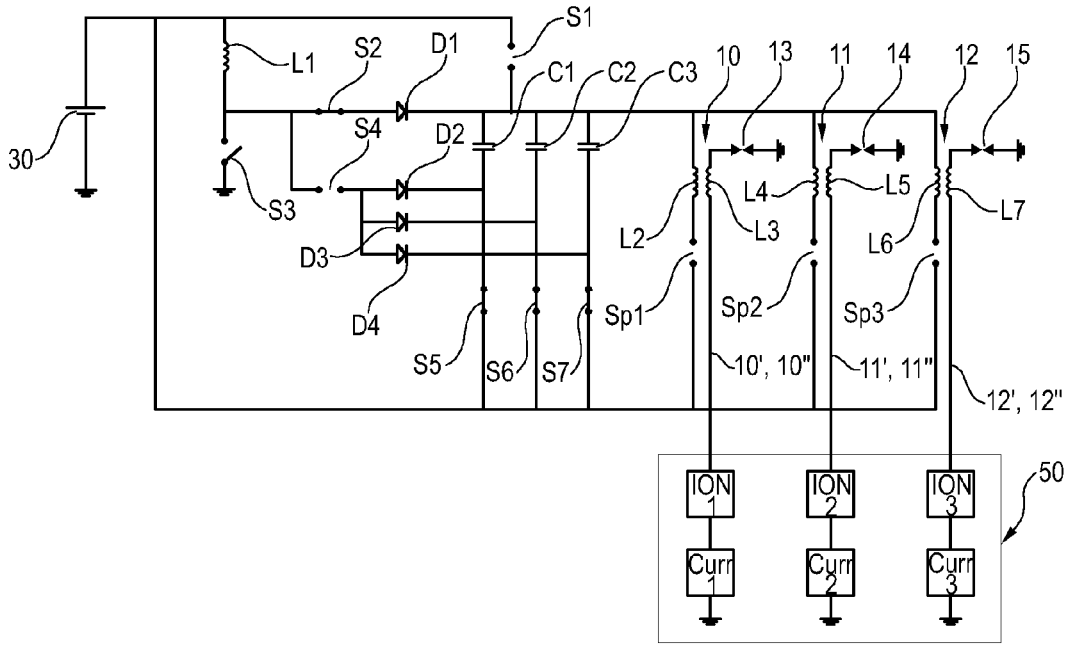

FIG. 4 shows the sequence after the choke coil L1 has reached the desired energy level from the power source 30; then the third switch S3 opens; the second S2, fifth S5, sixth S6 and seventh S7 switches close, and current flows through the first diode D1 to the storage capacitors C1, C2, C3.

Figure 3:
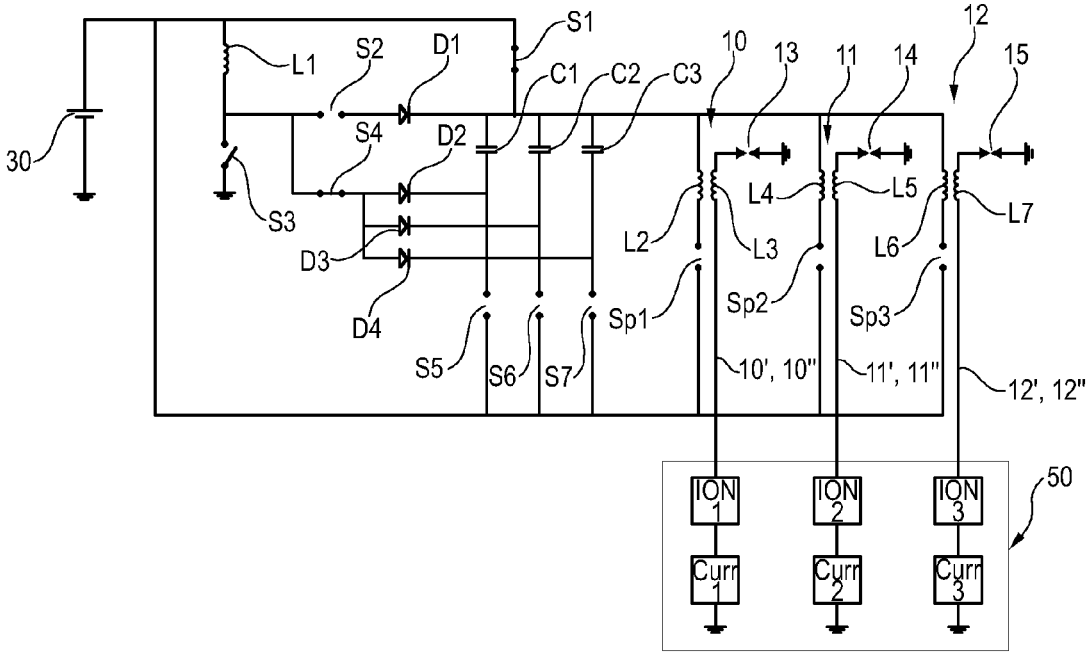

After the storage capacitors C1, C2, C3 have been charged as shown in FIG. 3 or FIG. 4, the first S1 and fourth S4 switches open, or the second S2 switch opens, whereupon the third coil switch Sp3 closes, along with the fifth S5, sixth S6 and/or seventh S7 switches (if not already closed). This produces a discharge of the first C1, second C2 and third C3 storage capacitors through the third ignition coil 12 via the lower conductor 70, the upper conductor 80 (see FIG. 5), the coil switch Sp3 and via each storage capacitor having a closed switch S5, S6, S7, the direction of the discharge current direction depending on whether the charging takes place via the second S2 switch or the fourth S4 switch.

By charging the storage capacitors C1, C2, C3, as described in connection with FIG. 3, a negative polarity of the spark is obtained, and by charging as described in connection with FIG. 4, a positive polarity of the spark is obtained. By choosing one of the charging options described above, therefore, the polarity of the spark can be controlled.

According to a preferred aspect, in order to achieve discharge of the three storage capacitors C1, C2, C3 in sequence, which provides the advantage of an increased burn time, the fifth switch S5 closes first when the storage capacitors C1, C2, C3 discharge (the sixth S6 and seventh S7 switches stay open) and after a certain delay, such as about 300 μs, the sixth switch S6 closes, and, consequently, after a further delay, the seventh switch S7 closes. By discharging the capacitors C1, C2, C3 in sequence, a long burn time can be achieved without a new sparkover occurring, which is an advantage as fewer sparkovers means reduced spark-plug wear.

Figure 5:
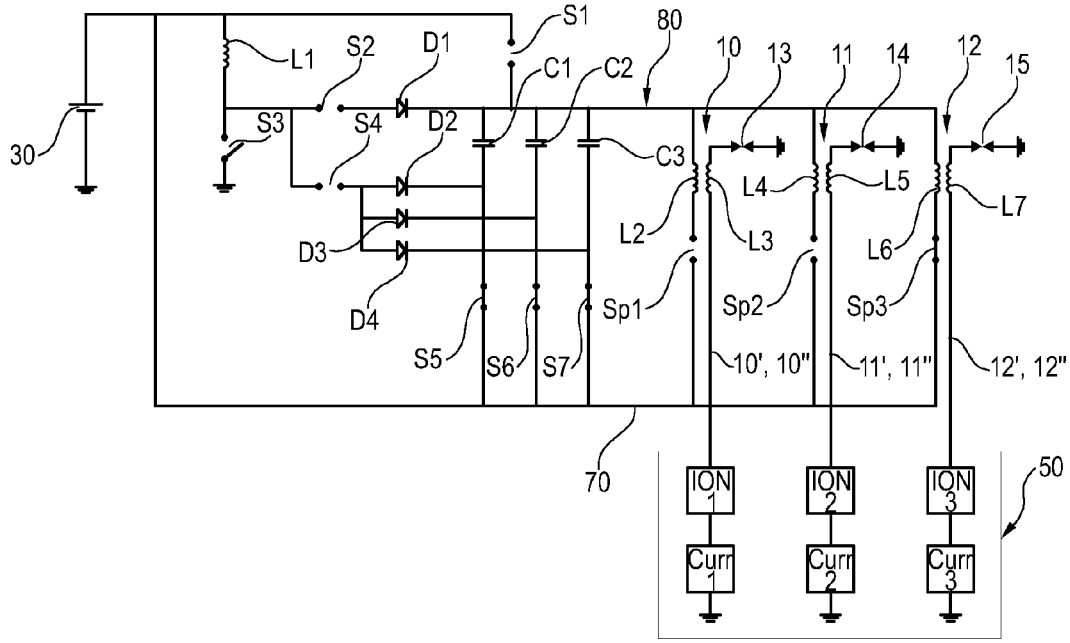
Figure 6:
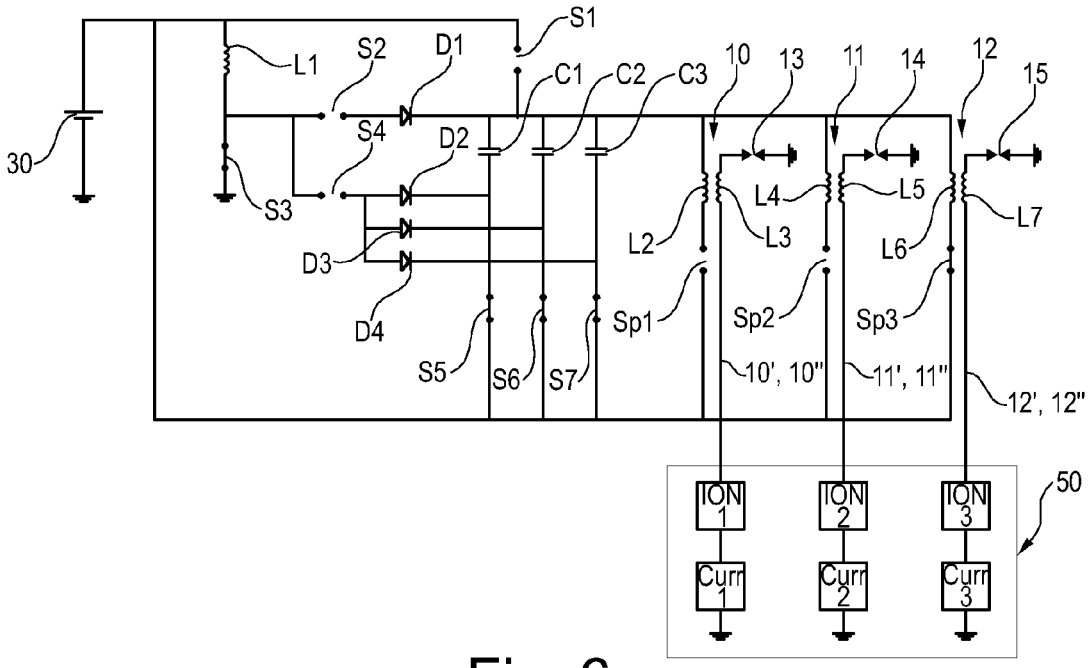

FIG. 6 shows another sequence in which the circuit diagram is the same as in FIG. 5, i.e., the discharge of the three storage capacitors C1, C2, C3 takes place through the third ignition coil 12. The fifth S5, sixth S6, seventh S7 switches and the third coil switch Sp3 are closed. The difference is that now the third switch S3 has also been closed, resulting in the charging of energy in the choke coil L1 from the power source 30 taking place simultaneously with the three storage capacitors C1, C2, C3 being discharged. The energy charged into the choke coil L1 can then be discharged directly into the third ignition coil 12 to give an additional boost of energy.

Figure 7:
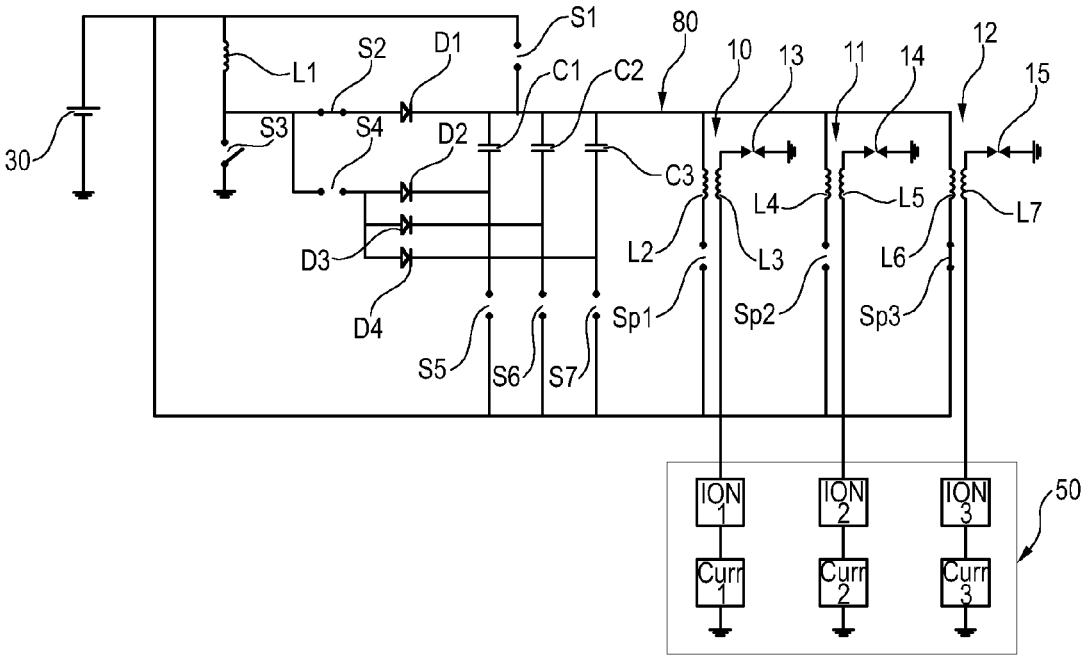

FIG. 7 shows how this energy boost is achieved in that, after charging of the choke coil L1, the fifth S5, sixth S6 and seventh S7 switches open at the same time as the second switch S2 closes, whereupon the third switch S3 opens, producing a discharge of the choke coil L1 through the first diode DI and the upper conductor 80 directly into the third ignition coil 12. This provides a boost of energy in the form of a non-oscillating to spark current.

Figure 8:
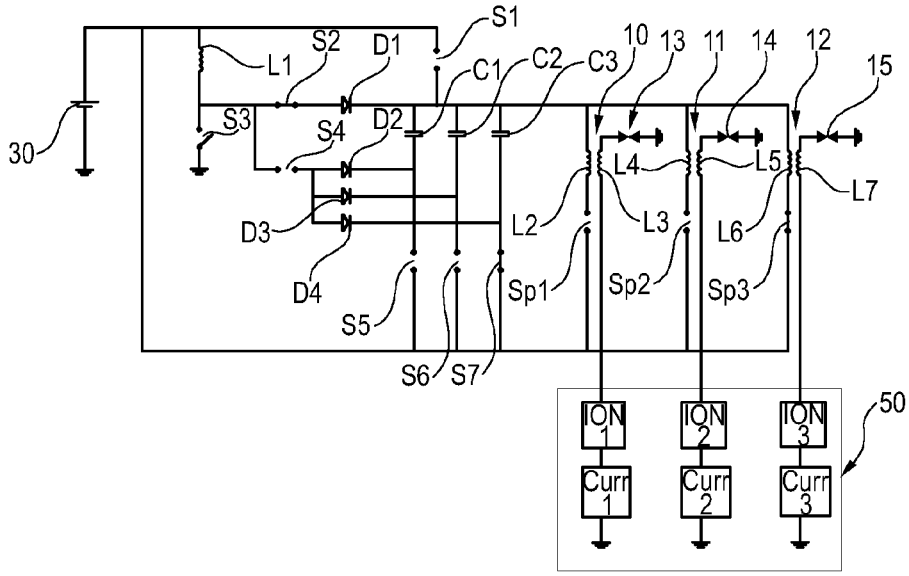

FIG. 8 shows another version of the energy boost, in which the discharge of the energy in the choke coil L1 takes place directly into the third ignition coil 12 and the third storage capacitor C3 by the opening of the third S3, fifth S5 and sixth S6 switches at the same time as the second switch S2 closes. This provides a boost of energy in the form of an oscillating spark current.

Figure 9:
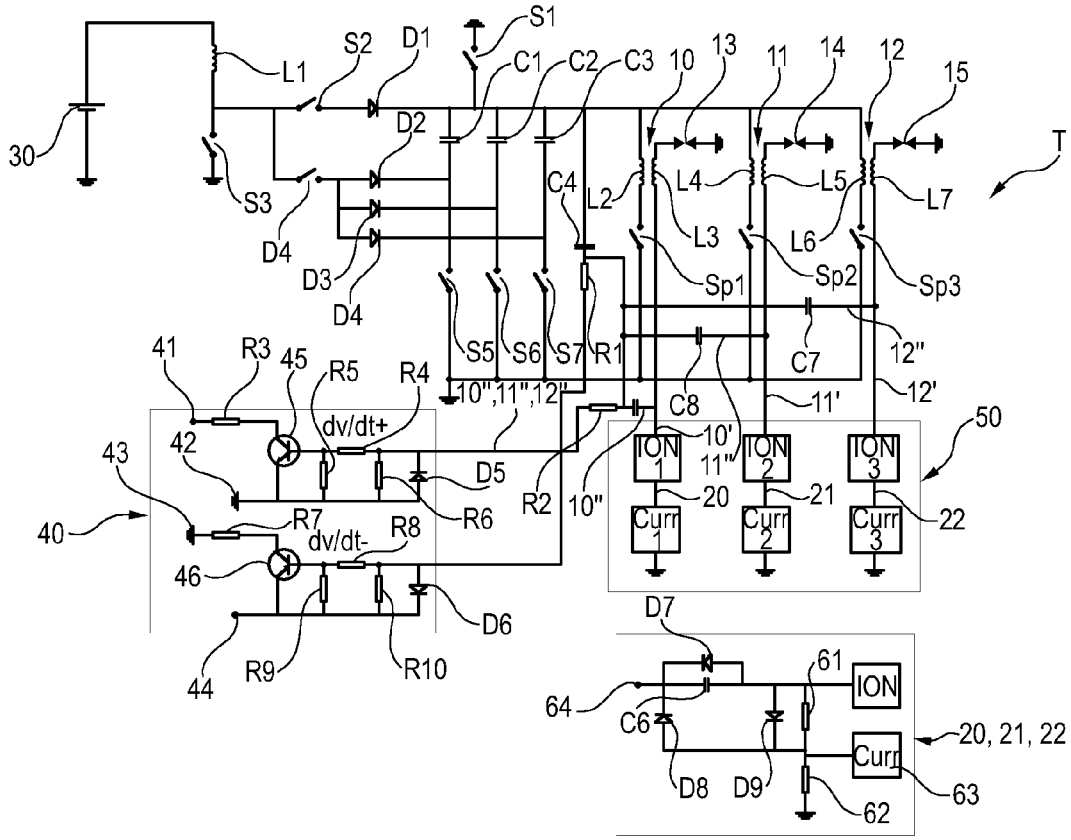
FIG. 9 shows an alternative circuit diagram of an ignition system according to the invention.

FIG. 9 shows an alternative circuit diagram of an ignition system T according to the invention.

Figure 10:
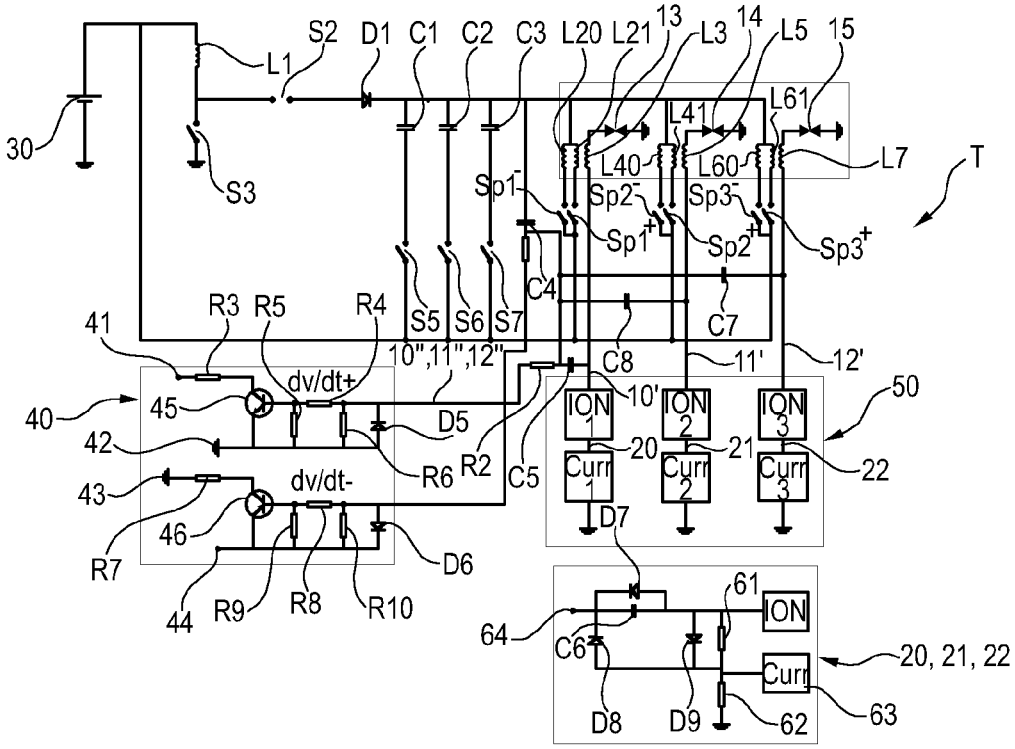
FIG. 10 shows a further alternative circuit diagram of an ignition system according to the invention.

FIG. 10 shows a further alternative circuit diagram of an ignition system T according to the invention. In this alternative, each spark plug 13, 14, 15 comprises a first L20, L40, L60 and a second L21, L41, L61 primary coil (and a secondary coil L3, L5, L7) wherein said first primary coil L20, L40, L60 includes a first coil switch Sp1−, Sp2−, Sp3−, and said second primary coil L21, L41, L61 comprises a second coil switch Spl+, Sp2+, Sp3+. Using this connection alternative, the first S1 and fourth S4 switches in the circuit diagrams shown in FIG. 1 and FIG. 9 can be omitted. However, this alternative limits the possibility to control peak current independently of spark energy.

With this alternative circuit diagram, it is also possible to operate a purely inductive ignition system, this being done by connecting the power source 30 directly to the cathode of the first diode D1, thereby sparing the choke coil L1 and the third switch S3 (not shown). Further, a connection is made directly from the anode of the first diode D1 to the primary coils L20, L40, L60, L21, L41, L61, which makes it possible to spare also the first C1, second C2 and third C3 storage capacitors, as well as the fifth S5, sixth S6 and seventh S7 switches. The first Sp1−, Sp2−, Sp3− and second Sp1+, Sp2+, Sp3+ coil switches are connected to ground and depending on whether the first or the second coil switch is activated, a positive or negative spark is obtained.

In this case, the voltage will be transformed up and energy will be stored directly in the primary coil(s) L20, L40, L60, L21, L41, L61 when the coil switch(es) Sp1−, Sp2−, Sp3−, Spl+, Sp2+, Sp3+ is/are closed, and a spark is generated when the coil switch Sp1−, Sp2−, Sp3−, Sp1+, Sp2+, Sp3+ opens.

Figure 11:
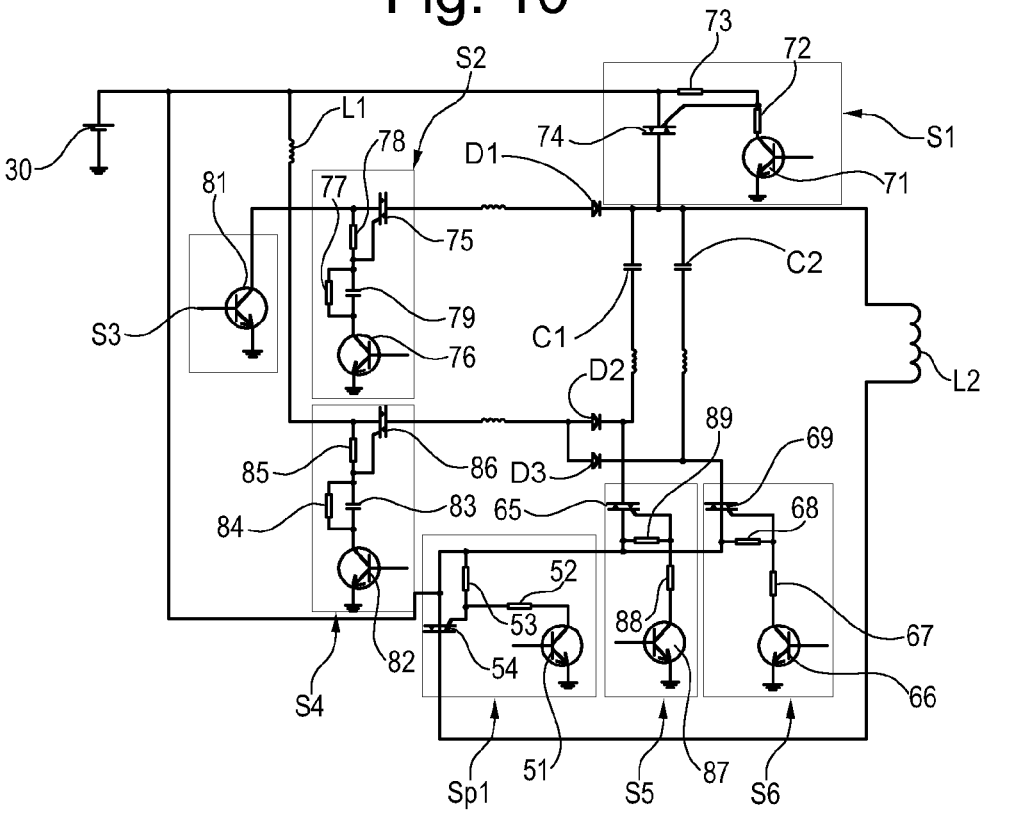
FIG. 11 shows a coupling of switches according to the invention.

FIG. 11 shows an alternative connection with switches to battery. The switches S1, S2, S3, S4, S5, S6 and the first coil switch Sp1 used in FIG. 1 are shown in detail. The second Sp2 and third Sp3 coil switches are built in the same way as the first coil switch Sp1, and the seventh switch S7 is built in the same way as the other switches S1-S6.

The first switch Si comprises a transistor 71, a resistor 73 and a TRIAC 74, the gate being connected to a further resistor 72.

The second switch S2 comprises a transistor 76, a capacitor 79, a first 77 and a second 78 resistor, and a TRIAC 75.

The third switch S3 comprises a transistor 81.

The fourth switch S4 comprises a transistor 82, a first 84 and a second 85 resistor, a capacitor 83 and a TRIAC 86.

The fifth switch S5 comprises a transistor 87, a first 88 and a second 89 resistor, and a TRIAC 65.

The sixth switch S6 comprises a transistor 66, a first 67 and a second 68 resistor, and a TRIAC 69.

The first coil switch Spl comprises a transistor 51, a first 52 and a second 53 resistor and a TRIAC 54. In the alternative embodiment with a purely inductive ignition system, said TRIAC in the coil switches is replaced by a transistor.

This is a known way to build switches, which is simple and inexpensive.

Figure 12:
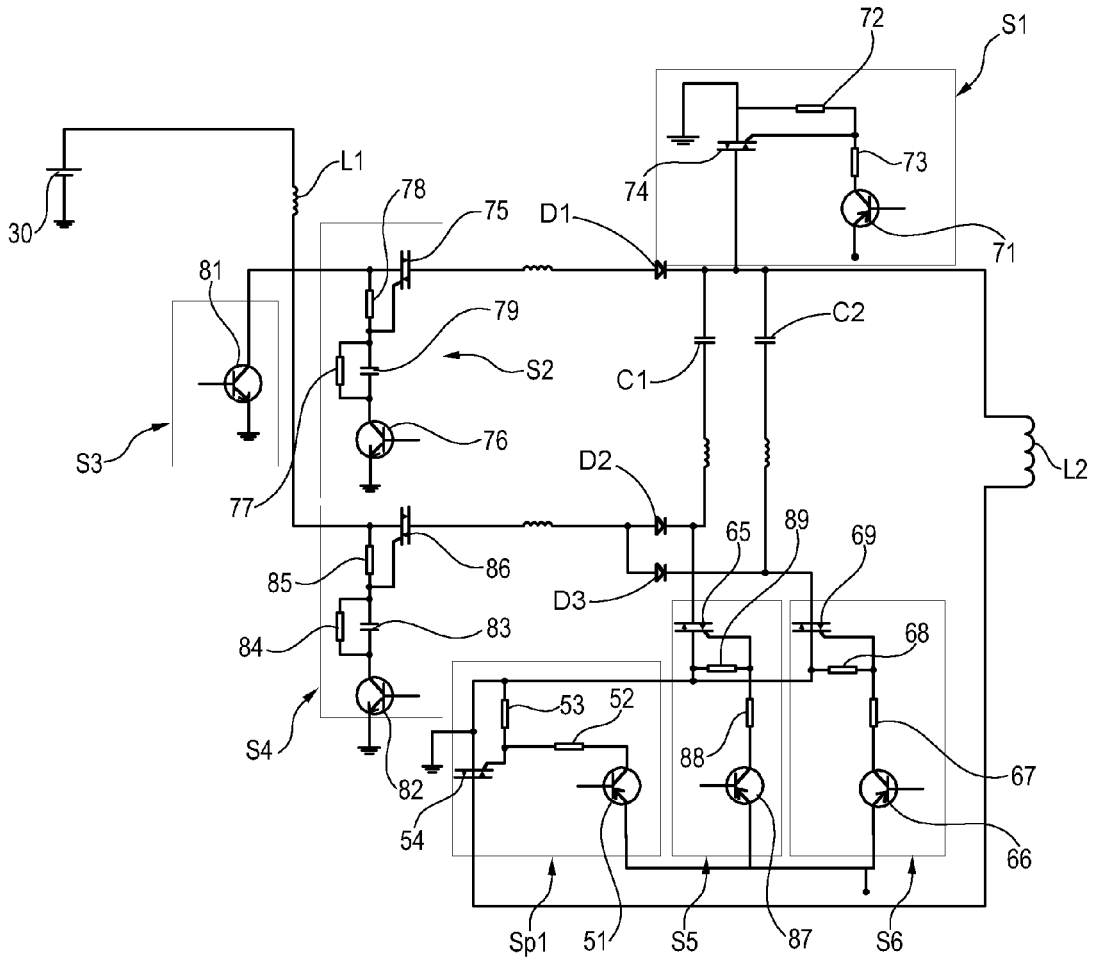
FIG. 12 shows an alternative coupling of a switch according to the invention.

FIG. 12 shows an alternative connection with switches to ground. The switches S1, S2, S3, S4, S5, S6 and the coil switch Sp1 used in FIG. 9 are shown in detail.

The first switch S1 comprises a transistor 71, a resistor 73 and a TRIAC 74, the gate being connected to a further resistor 72.

The second switch S2 comprises a transistor 76, a capacitor 79, a first 77 and a second 78 resistor, and a TRIAC 75.

The third switch S3 comprises a transistor 81.

The fourth switch S4 comprises a transistor 82, a first 84 and a second 85 resistor, a capacitor 83 and a TRIAC 86.

The fifth switch S5 comprises a transistor 87, a first 88 and a second 89 resistor, and a TRIAC 65.

The sixth switch S6 comprises a transistor 66, a first 67 and a second 68 resistor, and a TRIAC 69.

The first coil switch Sp1 comprises a transistor 51, a first 52 and a second 53 resistor and a TRIAC 54.

By measuring various parameters such as ignition voltage, misfire, burn time and peak-pressure position individually or in combination, the system can provide information on the energy combinations that work to achieve optimum combustion with minimum spark-plug wear. By varying the number of storage capacitors used for spark generation, the peak power can be varied without affecting the ignition voltage. Less peak power means less spark-plug wear.

If the spark goes out prematurely, a capacitor can be fired immediately to prevent misfire. When the spark goes out, the frequency of the spark current changes, which is an indication that a new spark is needed. This reduces the risk of misfire.

Under certain conditions in the engine, a quick sequence of rapid multi-sparks may pose a significantly lower risk of misfiring than one long continuous spark. This embodiment can be implemented by timing between the various capacitors and the choke-coil boost. When using rapid multi-sparks, the ion current can provide a notification that combustion has started so that the multi-spark can be terminated prematurely. This results in reduced spark-plug wear.

A low-impedance coil can be used without making burn time short. This allows the ion signal to better pass the coil, and measurement can start sooner after the spark.

By combining information about misfiring and need for ignition voltage, the energy needed for reliable ignition can be adapted. This results in reduced spark-plug wear.

By measuring how the sparkover voltage varies with the polarity, the polarity rendering the minimum ignition-voltage need can be used. This results in reduced spark-plug wear.

The invention is not limited to what has been described above, but can be varied within the scope of the appended claims. For example, it will be understood that instead of using TRIACs as switches, combinations of transistors and diodes in series and in parallel can be used to, in a manner known per se, provide the same kind of functionality as TRIAC. Further, those skilled in the art understand that switches can be placed elsewhere in the circuit (other than described above), which, however, requires the use of insulation techniques (e.g. capacitive insulation, or opto-couplers) or additional voltage converters for the operation of the gate of the switch. Furthermore, it will be understood that the choke coil can be designed with a secondary winding to be able to differentiate between inductances for the charging and discharging of choke-coil current.

Further, it will be understood that certain part(s) and/or the embodiments of the disclosed concept may be subject to separate protection in the form of divisional applications, in which reference is made, inter alia, to the purely inductive procedure, as described in connection with FIG. 10.

The invention claimed is:

1. An ignition system (T) for an internal combustion engine, the internal combustion engine comprising a control system, the ignition system (T) further comprising a power source (30), at least one ignition coil (10, 11, 12) having at least one primary coil (L2, L4, L6) and one secondary coil (L3, L5, L7) for a spark plug (13, 14, 15) and a measurement device (50) for measuring at least one of spark current, ion current, ignition voltage and primary voltage, said measurement device (50) being adapted to provide measurement signals to said control system for regulating the ignition system (T), characterised in that the ignition system (T) also comprises means for transforming up voltage and storing energy, and a plurality of switches (S1-S7), said control system being adapted to control said switches (S1-S7), by means of said measuring signal(s), for a supply of adaptive spark energy and/or to control a polarity of a spark.

2. The ignition system (T) as claimed in claim 1, characterised in that said means comprises at least one storage capacitor (C1-C3) which is charged from at least one choke coil (L1).

3. The ignition system (T) as claimed in claim 2, characterised in that said measurement device (50) comprises at least one ion-current circuit (20, 21, 22) arranged with a spark portion (61, 62) for measuring the spark current.

4. The ignition system (T) as claimed in claim 3, characterised in that said spark portion (61, 62) comprises a first (61) and a second (62) resistor having an order difference of at least $10^2$.

5. The ignition system (T) as claimed in claim 4, characterised in that the ignition system (T) further comprises an ignition-voltage measurement device (40) adapted to measure the ignition voltage.

6. The ignition system (T) as claimed in claim 5, characterised in that the ignition system (T) comprises at least one coil switch (Sp1-Sp3) triggering a start of the spark, and the ignition-voltage measurement device (40) comprises measurement circuits (41, 42, 43, 44), the measurement circuits (41, 42, 43, 44) indicating a sparkover thereof, whereupon the ignition voltage can be calculated.

7. The ignition system (T) as claimed in claim 6, characterised in that said measurement circuits (41, 42, 43, 44) consist of a first measurement circuit (41, 42) comprising a first transistor (45) used for measuring a positive polarity of the spark and a second measurement circuit (43, 44) comprising a second transistor (46) used for measuring a negative polarity of the spark.

8. The ignition system (T) as claimed in claim 7, characterised in that the first (41, 42) and second (43, 44) measurement circuits further comprise a voltage limiter (D5, D6).

9. The ignition system (T) as claimed in claim 8, characterised in that the control system is adapted to enable, by means of said switches (S1-S7), a connection of one or more storage capacitors (C1-C3) to the at least one primary coil (L2, L4, L6).

10. The ignition system (T) as claimed in claim 9, characterised in that the control system is adapted to measure, by means of the ignition-voltage measurement device (40), the ignition voltage by measuring a time elapsed from spark start, when the coil switch (Sp1-Sp3) closes, until a transient from the sparkover is captured in one of said measurement circuits (41, 42, 43, 44).

11. The ignition system (T) as claimed in claim 10, characterised in that the control system is adapted to detect misfiring by means of the measurement device (50).

12. The ignition system (T) as claimed in claim 11, characterised in that the control system is adapted to measure the spark current by means of the at least one ion-current circuit (22) in the measurement device (50) to detect whether the spark goes out prematurely.

13. The ignition system (T) as claimed in claim 12, characterised in that the control system is adapted to measure a frequency of the primary voltage to detect when the spark goes out.

14. The ignition system (T) as claimed in claim 13, characterised in that the control system detects, by means of the ion current, the position of a peak pressure.

* * * * *